US006149383A

United States Patent [19]

Davidson et al.

[11] Patent Number: 6,149,383

[45] Date of Patent: Nov. 21, 2000

[54] ROTATING MACHINE

[75] Inventors: Colin Davidson; James Walkingshaw, both of Cumbria, United Kingdom

[73] Assignee: United Utilities PLC, United Kingdom

[21] Appl. No.: 09/125,088

[22] PCT Filed: Feb. 14, 1997

[86] PCT No.: PCT/GB97/00419

§ 371 Date: Jan. 8, 1999

§ 102(e) Date: Jan. 8, 1999

[87] PCT Pub. No.: WO97/30289

PCT Pub. Date: Aug. 21, 1997

[30] Foreign Application Priority Data

Feb. 16, 1996 [GB] United Kingdom ..... 9603306

[51] Int. Cl.[7] ..... F01D 25/00; F03B 11/00

[52] U.S. Cl. ..... 415/121.2; 415/206

[58] Field of Search ..... 415/73, 121.2, 415/206, 225

[56] References Cited

U.S. PATENT DOCUMENTS

| | | | |
|---|---|---|---|
| 1,697,202 | 1/1929 | Nagle | 415/206 X |
| 2,409,497 | 10/1946 | Kessel | 415/121.1 X |
| 2,658,453 | 11/1953 | Walters | 415/121.1 X |
| 3,788,762 | 1/1974 | Partos | 415/121.1 X |
| 4,063,848 | 12/1977 | Wiggins et al. | 415/206 |
| 4,143,993 | 3/1979 | Blum | 415/121 B |
| 4,347,032 | 8/1982 | Possell . | |
| 4,386,780 | 6/1983 | Dernedde | 277/15 |
| 4,416,586 | 11/1983 | Diederich et al. | 415/121.2 X |
| 4,992,022 | 2/1991 | Aust et al. . | |
| 5,709,528 | 1/1998 | Hablanian | 415/121.2 X |

FOREIGN PATENT DOCUMENTS

| | | | |
|---|---|---|---|
| 1742516-A1 | 6/1992 | Russian Federation | 415/121.2 |

*Primary Examiner*—John E. Ryznic
*Attorney, Agent, or Firm*—Michael Best & Friedrich LLP

[57] ABSTRACT

A rotating machine such as a submersible pump which comprises a casing (1) and a rotor (2) which is rotatable relative to the casing (1). The casing defines an aperature adjacent to which the rotor is positioned such that an annular gap is formed around the aperture between a first surface defined by the rotor (2) and a second surface (9) defined by the casing (1). One or both of the first and second surfaces is provided with a surface structure which is operative to prevent the accumulation of material within the gap. The irregular surface may be defined by for example a screw thread.

17 Claims, 1 Drawing Sheet

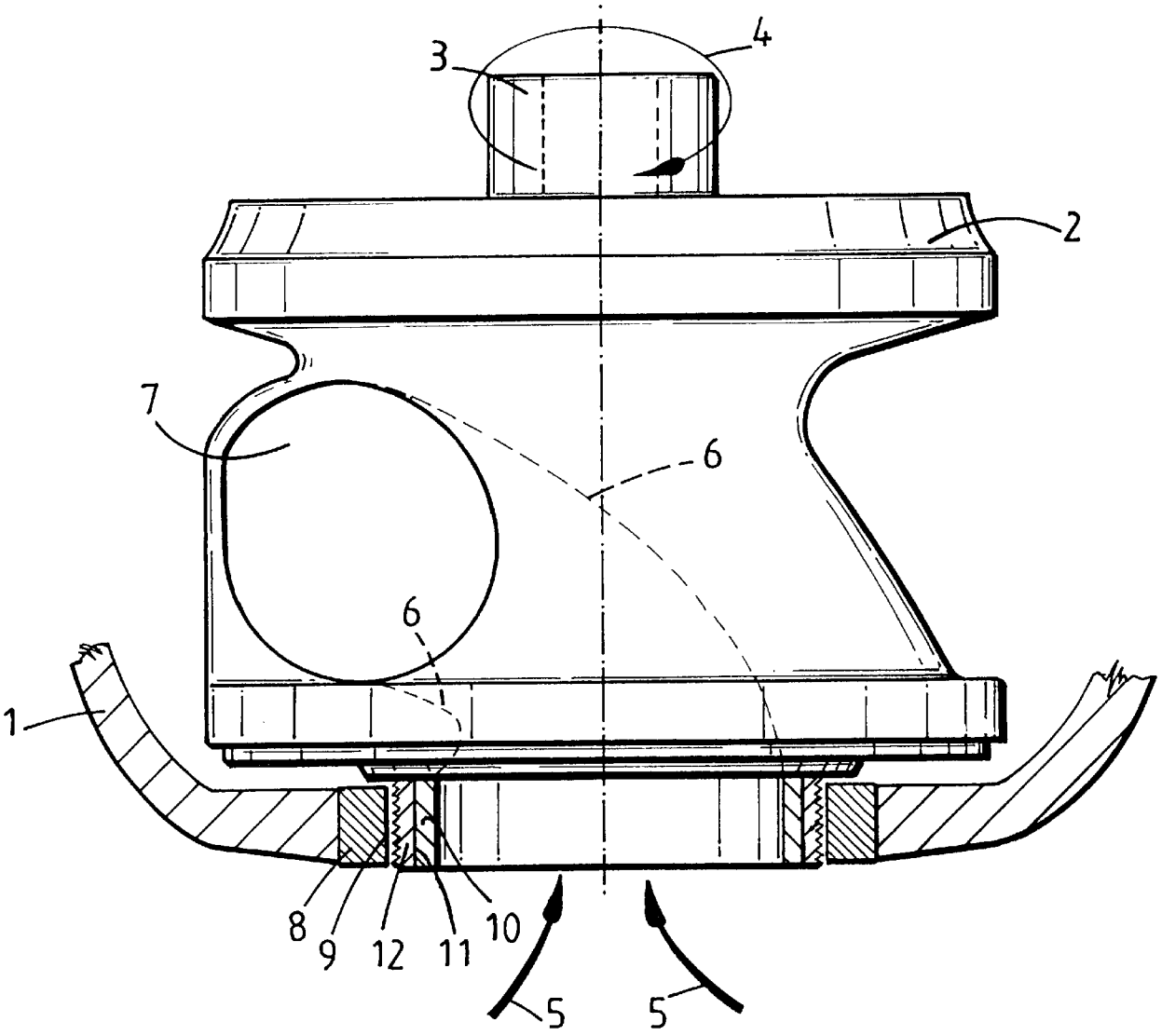
1
2
3
4
5
5
6
6
7
8
9
10
11
12

ROTATING MACHINE

The present invention relates to a relating machine comprising a casing and a rotor which is rotatable relative to the casing.

There are many examples of rotating machines in which a gap is defined between a rotor and a stator in an arrangement such that material can become jammed in the gap. For example, submersible pumps used to pump waste water generally comprise a rotor in the form of an impeller which is housed within a stator in the form of a casing. A circular aperture is defined in the casing and a tubular portion of the rotor extends into the aperture. If the impeller is turned within the casing when the casing is submerged in a fluid, fluid is drawn into the casing through a helical passageway defined within the impeller. Thus the motion of the impeller relative to the casing establishes a pressure difference between the fluid on the outside of the casing and the fluid within the casing. That pressure differential is also applied across the gap defined in the aperture in the casing by the portion of the impeller which extends into the casing.

In a conventional submersible pump widely used in the wastewater treatment industry, the aperture in the casing is defined by a brass sleeve which is received in a circular opening in the casing. The radially inner surface of the brass sleeve is smooth and faces a radially outer surface of the rotor which is also smooth. It is believed that these surfaces have been made smooth to reduce the likelihood of material becoming jammed between them. In the known pump the spacing between the two facing surfaces is 1.75 mm.

When the known pumps are used in waste water carrying fibrous articles, there is a tendency for fibres from those articles to become wound around the portion of the impeller within the casing apertures. Over time, material can build up in the gap between the two relatively rotating components, the pressure differential that the pump applies across the gap being instrumental in drawing material into the gap. As a result the known pumps are prone to failure. The applicants have monitored the failure rate of the known pumps and have discovered that the maximum time for which a monitored pump has run in waste water without jamming is 670 hours. Each time a pump jams it has to be taken out of service and generally the pump has to be fully refurbished at considerable expense. It would clearly be highly advantageous to be able to increase the service life of the known pumps. Given the relatively wide gap between the relatively moving faces of the impeller and casing, at least before that gap has become clogged with material, a significant flow of fluid occurs through the gap and this adversely affects the pump efficiency. It would be easy to increase pump efficiency by reducing the width of the gap, but presumably this has never been attempted in the past because of real or perceived fears that the already limited service life of the pump would be further reduced.

It is an object of the present invention to obviate or mitigate the problems outlined above.

According to the present invention, there is provided a rotating machine comprising a casing and a rotor which is rotatable relative to the casing, the rotor being positioned relative to an aperture in the casing such that an annular gap is formed adjacent the aperture between a first surface defined by the rotor and a second surface defined by the casing, wherein at least one of the first and second surface has a surface structure which is operative to prevent the accumulation of material within the gap.

The surface structure may be selected so as to progressively eject material from the gap as a result of the relative rotation of the first and second surfaces, or may be selected to progressively disintegrate any material between the surfaces. Preferably the surface structure is defined by a screw thread on one or more of the first and second surfaces. The screw thread may be formed on the first surface which is defined by the rotor and the second surface may be smooth.

The screw thread is preferably formed on a stainless steel sleeve. Where the rotor and casing define a pump which is operation generates a pressure differential between opposite sides of the gap, the screw thread is preferably arranged such that rotation of the rotor in a predetermined operating direction causes the thread to advance material in the gap to the relatively lower pressure side of the casing. The thread could be reversed however, particularly for applications where fluid losses are perceived as a greater problem than jamming, e.g. pumps operating in clean water. Such reversal would mean that the thread would tend to pump fluid from the low to the high pressure sides of the pump, thus reducing losses through the annular gap.

The thread preferably has a depth of from 1 to 2 mm and a pitch of from 1 to 3 mm.

The annular gap may be from 0.5 to 1.5 mm wide and may be defined on one side by the radially outer surface of a tubular member which rotates with the rotor.

An embodiment of the present invention will now be described, by way of example, with reference to the accompanying drawing.

In the drawing, a lower portion 1 of a casing of a submersible pump is shown in section adjacent a pump impeller 2. The impeller is rotated by applying torque to a drive shaft 3 in a direction indicated by arrow 4. Any fluid in which the pump casing is immersed is drawn by the impeller in the direction of arrows 5 into an aperture in a lowermost portion of the impeller. That aperture communicates via a helical path indicated by broken lines 6 with an opening 7 in the impeller through which fluid flows into the interior of the casing.

The lowermost portion of the impeller is generally tubular and extends into an opening defined by a sleeve 8 which is a tight fit within a circular opening defined in the casing 1. The lowermost portion only of the impeller is shown in section 1. The radially inner edge 9 of the sleeve 8 faces a tubular portion of the impeller. That tubular portion comprises an integral tubular element 10 the radially outer surface of which is indicated by line 11, and a sleeve 12 which is a tight fit on the tubular portion 10. For example the sleeve 12 may be heated and passed onto the portion 10 in a conventional manner. The radially outer surface of the sleeve 12 defines a screw thread which faces the surface 9 of the sleeve 8. Thus an annular gap is defined between a first surface represented by the screw threaded outer surface of the sleeve 12 and a second surface 9 defined by the sleeve 8.

When the pump is operating, a pressure differential is established through a gap defined between the surface 9 and threaded sleeve 12. As a result, although fluid and any material carried by that fluid is generally drawn into the impeller through the tubular opening defined by the impeller portion 10, some fluid is drawn into the gap defined between surface 9 and the sleeve 12. Any material which is drawn onto that gap however is engaged by the screw thread 12 the direction of which is such that as the rotor turns the screw thread tends to advance any material in the gap towards the interior of the casing. Any material which becomes adhered to the smooth surface 9 will tend to be dislodged by the action of the adjacent screw thread.

Pumps as illustrated in the accompanying drawing have been manufactured with the minimum spacing between the surface 9 and the crests of the screw thread on the sleeve 12 equal to 1 mm. This contrasts with known pumps where the equivalent dimension where neither component is threaded to 1.75 mm. This alone results in an improved pump efficiency. Thread depth was 1.35 mm and the thread pitch was 2.1 mm. The threads have been formed in one case such that material in the gap is progressively advanced towards the high pressure side of the pump, and in a second case such that material is advanced to the low pressure side of the pump. Both pumps were less inclined to jam than the known pump with no thread formed facing the gap, although the best results were obtained with a thread which caused the material in the gap to be progressively displaced to the low pressure side of the gap. One such pump has been operated for in excess of 2000 hours and still shows no sign of failure. Thus the simple expedient of forming a thread on a component of the pump has resulted in at least a trebling of the expected service life of the device.

In the pumps tested to date the brass wear ring of conventional pumps was replaced by a smooth surfaced ring as represented in the drawing by component 8. The component 12 was formed as a stainless steel ring into which the specified threads were cut.

Although the described device has proved highly successful, the mechanism upon which it relies is not yet fully understood. It may be that surface formations other than simple screw threads would prove to be equally or at least partially as effective. For example surface formations which simply disintegrate any material entering the gap between the relatively rotating components may be effective to prevent jamming. Similarly, structures other than screw threads which progressively displace material in the gap to one side thereof or the other may also be effective. Although in the described device the radially inner component defining one side of the gap has a thread formed upon it, both of the facing surfaces could have threads or other similar structures, or only the radially outer surface defining one side of the gap could be provided with a threaded or similar surface structure.

What is claimed is:

1. A rotating machine comprising a casing and a rotor which is rotatable relative to the casing, the rotor having an inlet, the rotor positioned relative to the casing such that a bypass gap is defined between the rotor and the casing with the bypass gap being spaced from the inlet, wherein a screw thread is positioned adjacent the bypass gap on at least one of the rotor and the casing such that material entering the bypass gap is progressively ejected.

2. A rotating machine according to claim 1, wherein the screw thread is formed on the rotor.

3. The rotating machine according to claim 2, wherein a surface of the casing adjacent the bypass gap is smooth.

4. A rotating machine according to claim 1, wherein the screw thread is formed on a stainless steel sleeve.

5. A rotating machine according to claim 1, wherein in operation, a pressure differential is generated between opposite sides of the bypass gap and the screw thread is arranged such that rotation of the rotor in a predetermined normal operating direction causes the thread to advance material in the bypass gap to the relatively lower pressure side of the casing.

6. A rotating machine according to claim 1, wherein the rotor is an impeller.

7. A pump comprising a casing and an impeller which is rotatable relative to the casing, the impeller being positioned relative to an aperture in the casing such that an annular gap is formed adjacent the aperture between a first surface defined by the impeller and a second surface defined by the casing, wherein a screw thread is formed on at least one of the first and second surface such that material entering the gap is progressively ejected therefrom as a result of interaction with the surfaces, thereby preventing the accumulation of material within the gap.

8. A pump according to claim 1, wherein a screw thread is formed on the first surface only, and the second surface is smooth.

9. A pump according to claim 1, wherein the surface structure is such that material within the gap is progressively disintegrated as a result of interaction with the surface structure.

10. A pump according to claim 1, wherein the screw thread is formed on a respective stainless steel sleeve.

11. A pump according to claim 1, wherein the pump in operation generates a pressure differential between opposite sides of said gap and the screw thread is arranged such that rotation of the impeller in a predetermined normal operating direction causes the thread to advance material in the gap to the relatively lower pressure side of the casing.

12. A pump according to claim 1, wherein the thread has a depth of from 1 to 2 mm and a pitch of from 1 to 3 mm.

13. A pump according to claim 1, wherein the spacing between the first and second surfaces is such that the minimum clearance between those surfaces is from 0.5 to 1.5 mm.

14. A pump according to claim 1, wherein the first surface is defined by the radially outer surface of a tubular member rotating with the impeller.

15. A pump according to claim 1, wherein the screw thread is formed on a tubular sleeve which is fitted around a tubular portion of the impeller.

16. A rotating machine comprising a casing and a rotor which is rotatable relative to the casing, the rotor being positioned relative to an aperture in the casing such that an annular gap is formed adjacent the aperture between a first surface defined by the rotor and a second surface defined by the casing, wherein a screw thread is formed on at least one of the first and second surfaces such that material entering the gap is progressively ejected therefrom as a result of interaction with the surfaces, thereby preventing the accumulation of material within a gap, wherein the thread has a depth of from 1 to 2 mm and a pitch of from 1 to 3 mm.

17. A rotating machine comprising a casing and a rotor which is rotatable relative to the casing, the rotor being positioned relative to an aperture in the casing such that an annular gap is formed adjacent the aperture between a first surface defined by the rotor and a second surface defined by the casing, wherein a screw thread is formed on at least one of the first and second surfaces such that material entering the gap is progressively ejected therefrom as a result of interaction with the surfaces, thereby preventing the accumulation of material within the gap, wherein the spacing between the first and second surfaces is such that the minimum clearance between those surfaces is from 0.5 to 1.5 mm.

* * * * *